United States Patent [19]

Frei et al.

[11] Patent Number: 4,661,379

[45] Date of Patent: Apr. 28, 1987

[54] METHOD AND APPARATUS FOR APPLYING STRIP-SHAPED POWDER LAYER TO A CAN BODY OR THE LIKE, AND POWDER-CARRYING CAN BODY

[75] Inventors: Siegfried Frei, Schoeckstrasse 3, 9000 St. Gallen; Ernst Hohl, Wittenbach, both of Switzerland

[73] Assignee: Siegfried Frei, St. Gallen, Switzerland

[21] Appl. No.: 797,919

[22] Filed: Nov. 14, 1985

Related U.S. Application Data

[63] Continuation-in-part of Ser. No. 628,129, Jul. 9, 1984, abandoned, which is a continuation of Ser. No. 478,279, Mar. 24, 1983, abandoned.

[30] Foreign Application Priority Data

| | | | |
|---|---|---|---|
| Apr. 27, 1982 | [CH] | Switzerland | 2562/82 |
| Aug. 24, 1982 | [CH] | Switzerland | 5024/82 |
| Feb. 23, 1983 | [CH] | Switzerland | 1004/83 |

[51] Int. Cl.[4] ..... B05D 1/12

[52] U.S. Cl. ..... 427/181; 427/233; 427/234; 427/286; 427/424; 118/308; 118/317

[58] Field of Search ..... 427/181, 233, 234, 286, 427/424; 118/308, 317

[56] References Cited

U.S. PATENT DOCUMENTS

| | | | |
|---|---|---|---|
| 2,455,785 | 12/1948 | Larson | 118/315 |
| 3,526,027 | 9/1970 | Manuel | 118/312 |
| 3,713,862 | 1/1973 | Winkless | 118/624 |
| 4,205,621 | 6/1980 | Payne et al. | 118/622 |
| 4,212,266 | 7/1980 | Payne et al. | 118/622 |
| 4,215,648 | 8/1980 | Stamets et al. | 427/181 |
| 4,343,436 | 8/1982 | Lehmann | 427/181 |

FOREIGN PATENT DOCUMENTS

| | | |
|---|---|---|
| 54757 | 6/1982 | European Pat. Off. . |
| 2933641 | 3/1980 | Fed. Rep. of Germany . |
| 3001931 | 2/1982 | Fed. Rep. of Germany . |
| 3117715 | 11/1982 | Fed. Rep. of Germany . |
| 603249 | 8/1978 | Switzerland . |

*Primary Examiner*—Shrive P. Beck
*Attorney, Agent, or Firm*—Werner W. Kleeman

[57] ABSTRACT

In order to apply a strip-shaped powder layer onto the inside of a can body to cover a welding seam of the can body in a controlled manner, the can body is moved in a predetermined direction over a spraying head transporting the powder, due to the kinetic energy imparted thereto by a moving air current, to an elongated opening of the spraying head. This elongated opening flow communicates with a spray chamber of the spraying head and is located opposite the welding seam of the can body. While the can body moves past the spraying head there is formed a strip-shaped powder layer at the welding seam without any cloud formation of the powder in the spray chamber. Advantageously, a vacuum action is applied immediately adjacent the outlet opening where the powder conveyed by the moving air current is introduced as a bundled powder jet into the spray chamber of the spraying head, so that the bundled powder jet entering this spray chamber is retained in its jet-like configuration through removal of the air current serving as carrier air for the powder particles. In this way, the powder particles are not deflected out of their intended flight path or trajectory towards the welding seam.

29 Claims, 10 Drawing Figures

METHOD AND APPARATUS FOR APPLYING STRIP-SHAPED POWDER LAYER TO A CAN BODY OR THE LIKE, AND POWDER-CARRYING CAN BODY

CROSS-REFERENCE TO RELATED APPLICATIONS

This application is a continuation-in-part of the commonly assigned, co-pending U.S. application Ser. No. 06/628,129, filed July 9, 1984, now abandoned which, in turn, is a continuation of the commonly assigned U.S. application Ser. No. 06/478,279, filed Mar. 24, 1983, now abandoned.

BACKGROUND OF THE INVENTION

The present invention relates to a new and improved method and apparatus for applying a substantially strip-shaped powder layer, particularly on a welding seam of a container or vessel, such as a can body, and also to the can body itself.

It is known to coat the welded longitudinal seams of can bodies with electrostatically charged powder. This method is utilized for can bodies in which sensitive filling materials are stored. Polymeric resins, such as for example epoxy resin, polyethylene and the like are frequently utilized as the powder for coating. The powder finely distributed in an air stream is supplied to the welding seam and electrostatically charged shortly before making contact with the seam.

When the powder leaves the transport passage it is distributed over a region which is wider than the dimension of the welding seam. It also therefore coats such parts of the can body which must not be coated. On the other hand, a quantity of powder applied directly onto the welding seam, which often has a sharp edge, is insufficient to guarantee a reliable coating of the seam.

U.S. Pat. No. 3,713,862, granted Jan. 30, 1973, discloses a method in accordance with which there is provided a band which covers the lateral regions of the seam, so that a definite small and uniform powder strip is applied onto the outer side of the seam. Coating of the inner side of the seam, however, is not possible with this method, since the covering band provided with slots cannot be guided through the welded or, in other words, closed can body. A uniform powder application over the whole cover region is furthermore not suitable. When there is applied a sufficient quantity of powder to reliably cover the welding edges of the seam, too much material lies in the lateral regions. Taking into consideration the high price of the powder, this is of course retained low, the welding seam becomes insufficiently coated.

German Offenlegungsschrift No. 2,933,641, which is cognate to U.S. Pat. No. 4,215,648, granted Aug. 5, 1980, describes a powder applying apparatus in which the lateral powder dissipation is prevented by partial separation of the air from the powder shortly before the discharge of the powder from the spraying head. The powder is separated from the air shortly before it reaches the seam by centrifugal separation, for example with a return track curve, then is chamber, and at that location charged by a row of electrodes also arranged parallel to the seam. The air stream which is supplied parallel to the powder stream also into the spraying chamber positively mixes with the powder and forms a powder-air cloud. This apparatus, however, does not render possible any concentrated application of the powder at the seam with a small quantity of powder particles dissipating into the surroundings. A predetermined distribution of the powder transverse to the seam region is therefore not possible.

In a further development of the above-mentioned German Offenlegungschrift No. 2,933,641, reference being had to European patent application Ser. No. 54,575, the spraying chamber is composed of a porous material. Gas or air is blown into the spraying chamber through the porous material in order to blow the powder particles which are brought substantially parallel to the welding seam, against the seam region. A predetermined application which covers only a very small region of the seam is excluded with this apparatus. This apparatus positively leads to a great powder region.

Swiss Pat. No. 603,249 discloses a spraying head for a powder applying apparatus, which is provided with a plurality of bars and guiding sheets extending transverse to the flow direction of the powder-air mixture. The bars and sheets brake the powder-air stream and deflect it against a discharge slot which is laterally limited by flexible strips. A further deflecting element is provided, formed by a plurality of guiding sheets extending transverse to the slot. With the air of additional air blown through i.e. jets or nozzles, druses, the powder-air stream is additionally supported in the rear region of the spraying head.

The utilization of baffles of different shapes for braking and deflecting the air-powder mixture results in a very complicated construction of the spraying head, which also has a tendency towards clogging, for example powder nesting. The distribution of powder obtained by guiding and braking elements takes place at the cost of a very high throughflow quantity of powder and air, which must be withdrawn in greater part by aspiration and then recycled again. In addition to the cost of pressure air and suction air, the recycling and loss of a part of the returned powder leads to further losses.

All known powder applying arrangements or apparatuses produce directly or indirectly in a spraying chamber a powder-air cloud which is electrostatically charged in the spraying chamber and then applied against the seam which moves over the spraying chamber, due to its charging, as well as due to the superpressure and the air stream in chamber. Despite efficient suction hoods which are located above the spraying chamber, many powder particles still will be deposited on the outer side of the can body. The greatest mass of the powder particles supplied to the spraying chamber travel into the aspirating device and must be cleaned in a recycling device.

SUMMARY OF THE INVENTION

Accordingly, it is an object of the present invention to provide an apparatus and a method of applying a powder layer in a manner which avoids the disadvantages of the prior art.

It is a further object of the present invention to coat the sensitive central region of a welding seam reliably with a thick layer, and at the same time to coat the outwardly located regions to a properly required extent.

Another object of the present invention is to bring the powder in an air stream or current onto the welding seam with only a small quantity of transporting air and to deposit in a cloudless manner and in a substantially strip-shaped configuration the powder particles at the welding seam.

A further object of the present invention is to design the apparatus so that it can be located as close as possible to the welding machine.

Yet another important object of the present invention is concerned with an improved apparatus and method of applying a powder layer to a welding seam, wherein a spray chamber of a spraying head is maintained under vacuum conditions at a pressure lower than the pressure of the surrounding atmosphere, so that the carrier gas, typically air, transporting the powder particles is substantially removed from the influxing bundled jet composed of the powder particles and the carrier gas, to thereby retain the bundled jet configuration of the powder jet, whereby reliable and accurate deposition of powder particles onto the weld seam in the form of a substantially strip-shaped powder layer is achieved.

In keeping with these objects and with others which will become apparent hereinafter, one feature of the present invention resides, briefly stated, in a method in accordance with which a powder is applied onto a welding seam of a can body in a substantially jet-like configuration due to the kinetic energy of the powder particles and without the formation of a cloud of the infed powder and air mixture of stream.

It is another feature of the present invention that the apparatus provides for at least one supply passage which opens into a substantially slot-shaped spraying or spray opening and is arranged so that the powder will be discharged from the supply passage at an angle to the welding seam.

Yet another feature of the present invention resides in the distribution of the powder-air stream into several zones having different application widths. This makes it possible, in a surprising manner, to obtain a reliable coating of the sensitive central region of the welding seam, with a reduced quantity of powder.

A further feature of the present invention is the distribution of the powder-air stream into several passages so that the application thickness in the individual regions can be varied.

Still a further feature of the present invention is extending or bringing the supply passages to the vicinity or the welding seam, so that the apparatus can operate with a smaller air quantity and lower pressure, and therefore only a smaller powder surplus will need to be recycled and, in addition, less powder particles fling near the welding seam. A concentrated application of the powder onto the welding seam without static loading or charging is also possible.

In accordance with yet a further feature of the present invention, two supply passages are arranged near one another so as to dose the powder layer transverse to the welding seam.

When in accordance with another feature of the invention the supply passages extend helically, clogging of the apparatus is reliably prevented.

An additional feature of the invention is that the aspiration is performed near the passage outlet opening or discharge, so that the surplus powder is readily removed from the application zone. As this powder has not been soiled, it need not be cleaned.

Another aspect of the invention is the provision in the apparatus of a chamber shaped as a tapered ring, in which the powder-air stream can be distributed in a flow-free manner.

A still further feature of the invention is that the apparatus can be provided directly on the welding machine, and because of a short transport path from the welding location to the apparatus, an exact positioning of the seam relative to the spraying head is rendered possible and the powder can adhere to the seam which is still hot from welding and can be exactly applied onto the same.

It is also possible to heat the welding seam or to maintain its heat so that the powder can be applied with a low charge or even without any charging. In many cases friction charging of the powder in the supply passages is sufficient so that the powder will adhere to the welding seam.

Yet a further important aspect of the present invention contemplates applying a vacuum action immediately adjacent the outlet opening or discharge of the at least one supply passage which infeeds the powder-air stream or mixture by virtue of the kinetic energy of the powder particles against the weld seam. The vacuum which is thus applied enables a predetermined or defined withdrawal of the air from the influxing bundled jet-like powder-air stream or mixture. Consequently, the powder particles are maintained in their desired flight path or trajectory extending towards the welding seam and are not deflected out of such desired flight path or trajectory. By sucking off or removing the carrier gas, namely the air of the air stream, in a direction essentially parallel to but opposite the flight path of the powder particles towards the weld seam there is enhanced the reliable deposition of the powder particles at the welding seam in a defined cross-sectional configuration of the deposited powder. Furthermore, establishment of the vacuum conditions within the spray chamber of the spraying head prevents undesirable flow of the powder particles laterally of the strip-shaped powder layer which has been deposited onto the weld or welding seam, whereby there can be beneficially avoided the use of heretofore otherwise required lateral limiting or sealing brushes along the spray opening of the spray chamber.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DESCRIPTION OF THE PREFERRED EMBODIMENTS

The treating, recycling and melting of powder into a homogeneous layer on a welding or weld seam are not an object of the present invention, and they will be described only to the extent which is needed for understanding the present invention.

Figure 1:
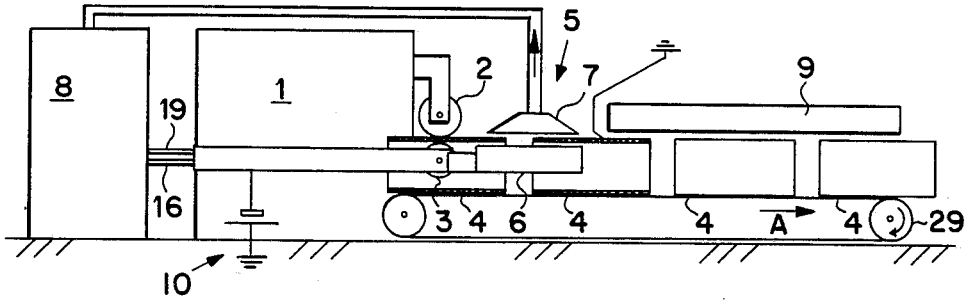
FIG. 1 is a schematic elevational view of a powder applying apparatus on a welding machine for producing longitudinal seams on containers or vessels defining can bodies.

Turning now specifically to FIG. 1, there is schematically shown a can body seam welding machine 1 which has electrode rollers 2 and 3. Several newly welded containers or vessels, here can bodies 4 are shown, as well as a powder applying device 5 with a spraying or spray head 6, an outer aspirating device 7, a combined treating and recycling device 8, and a melting device 9 of well-known construction for melting the powder on the seam. An electrical device 10 for generating the high voltage for charging the powder is also shown schematically in FIG. 1.

Figure 2:
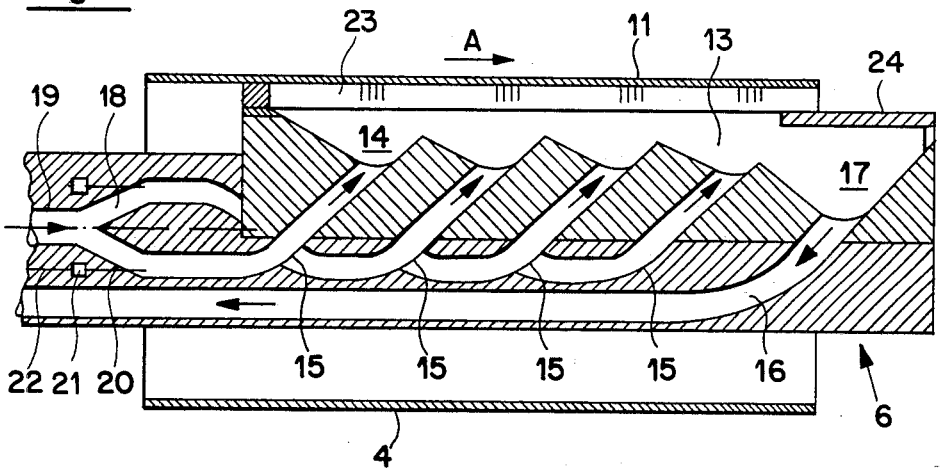
FIG. 2 is a large scale fragmentary longitudinal sectional view of a spraying device of the powder apparatus, in accordance with the present invention.

A large scale longitudinal section of the spraying or spray head 6 is shown in FIG. 2. A can body 4 is located on the spraying head 6, and such can bodies 4 passes the spraying head 6 from the left to the right in the direction of arrow A. An upper section 11 of the can body 4 is taken through the welding seam 12 of the can body 4, and lies above a spraying opening 13. Several supply passages 15 for a powder-air mixture are inclined to the horizontal and open into a spray chamber 14 flow communicating with the spraying or spray opening 13. A further aspiration passage or passageway 16 is connected to an aspirating device that leads to the treating device 8.

The supply passages 15 begin in a chamber 18 that is formed as a tapered ring, in which the powder-air mixture that has been received from a passage 19 is distributed into the supply passages 15. Needle-shaped electrodes 20 can extend into the chamber 18. These electrodes 20 are located coaxially relative to the supply passages 15 that extend from the chamber 18. The electrodes 20 are connected to a high voltage device 10 by means of an annular copper electrode 21 and a conductor 22.

Depending on the diameter of the can body 4, there may be insufficient space for all the passages 15 to be arranged in the lower half of the spraying or spray head 6 parallel to one another. When the diameter of the can body 4 is less than 65 mm, the passages 15 extend advantageously helically from the chamber 18, as shown in FIG. 2 of the drawing.

The spraying or spray opening 13 can be provided with lateral sealing elements 23 in the form of rubber strips or bristle strips. These sealing elements 23 serve for sealing or laterally limiting the powder discharged from the can body 4. A head chamber 17 is closed upwardly from the can body 4 by a cover 24.

It is possible, however, to have the passage or passageway 16 generate a pressure in the spray or spraying chamber 14 which is lower than the pressure of the surrounding atmosphere. In this way there can be beneficially eliminated the need for using the lateral sealing elements 23, since the thus established vacuum conditions within the spray chamber 14 tend to retain the influxing bundled jet-like powder-air mixture in a bundled jet-like configuration having a defined or predetermined cross-section. This is so because by virtue of the vacuum conditions prevailing in the spray chamber 14 the air of the infed powder-air mixture is substantially removed therefrom, which, as stated, promotes the retention of the jet-like configuration of the powder particles propelled through their kinetic energy in the direction of the weld seam and there is not formed any spray cloud of the powder particles in the spray chamber 14. Also, the vacuum conditions established within the spray chamber 14 tend to draw in air from the surrounding atmosphere and such indrawn air moves along the outer skin of the bundled jet-like powder-air mixture introduced into the spray chamber 14, to thus beneficially retain the bundled jet-like configuration thereof.

Furthermore, it is advantageous if the vacuum conditions are established at the floor or base of the spray chamber 14 and, specifically, near to the outlet opening or discharge of the related passage 14 from which effluxes the jet-like powder-air mixture. The carrier air which is removed from the powder-air mixture is sucked off by the vacuum action prevailing in the spray chamber 14 in a direction opposite to the intended trajectory or flight path of the introduced bundled jet-like powder-air mixture, so that the powder particles are not deflected out of their intended flight path or trajectory which carries them in a defined manner towards the weld seam. The powder is thus propelled by its kinetic energy, imparted to the powder particles by the carrier gas, namely here the air, in a most reliable, efficient manner and along a defined trajectory towards the weld seam.

Figure 3:
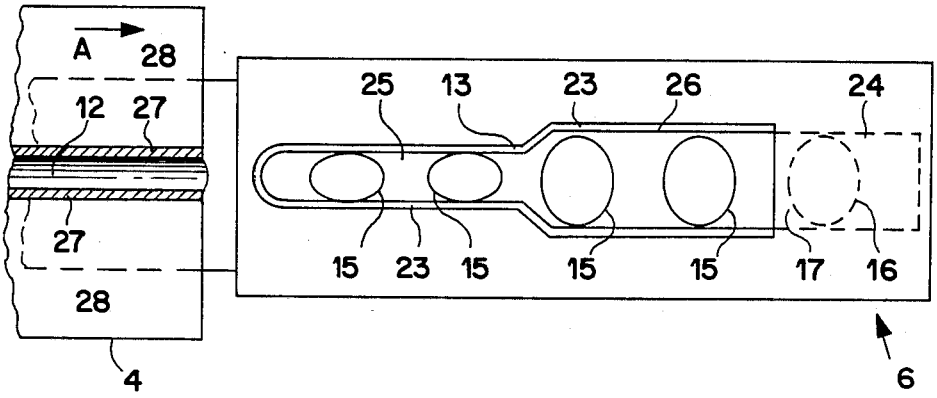
FIGS. 3 and 4 are fragmentary plan views of the spraying device of FIG. 2 in accordance with two different embodiments, respectively, of the present invention.

Continuing and as can be seen from FIG. 3, the spraying or spray opening 13 in the spraying or spray head 6 has two slot zones 25 and 26 of different widths. The slot zone 25 which is located at the inlet side, as considered in the transporting direction A of the can body 4, is smaller than the slot zone 26 located at the outlet side. The central part of the can body 4 shown in FIG. 3, represents the welding or weld seam 12. Recesses 27 are shown immediately adjacent thereto which are free from lacquer, and a protective coating, for instance a lacquer coating 28 is applied in flat condition onto the sheet material of the can body 4 outside the recesses 27.

The approximate widths of the welding seam, the neighboring regions 27 which in some cases can also be coated, and the slot zones 25 and 26 can be recognized from FIG. 3 of the drawing. The small zone 25 is insignificantly wider than the seam 12, whereas the wider zone 26 exceeds the entire width of the seam 12 and the recesses 27.

Figure 4:
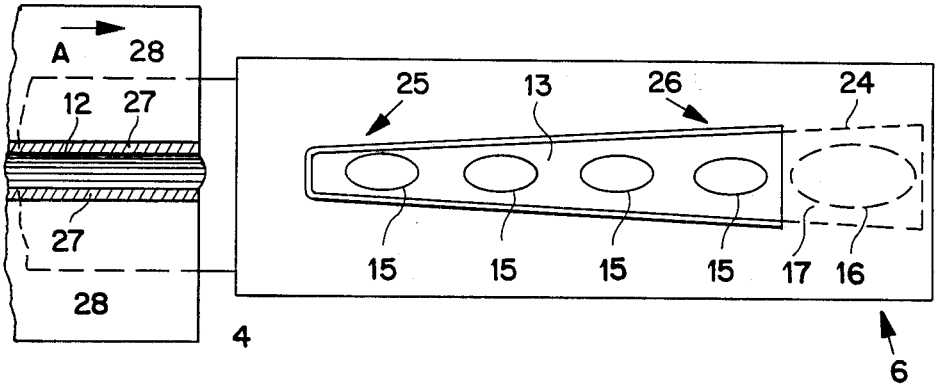

In accordance with a modification shown in FIG. 4, the spraying opening 13 continuously increases from the inlet side to the outlet side of the spraying head 6. The supply of the powder-air mixture, however, continues to be distributed into a plurality of the supply passages 15, as had been shown in the embodiment of FIG. 2.

It is to be understood that instead of four passages 15 provided in the shown example, a smaller number or a greater number of these passages can also be provided.

Figure 5:
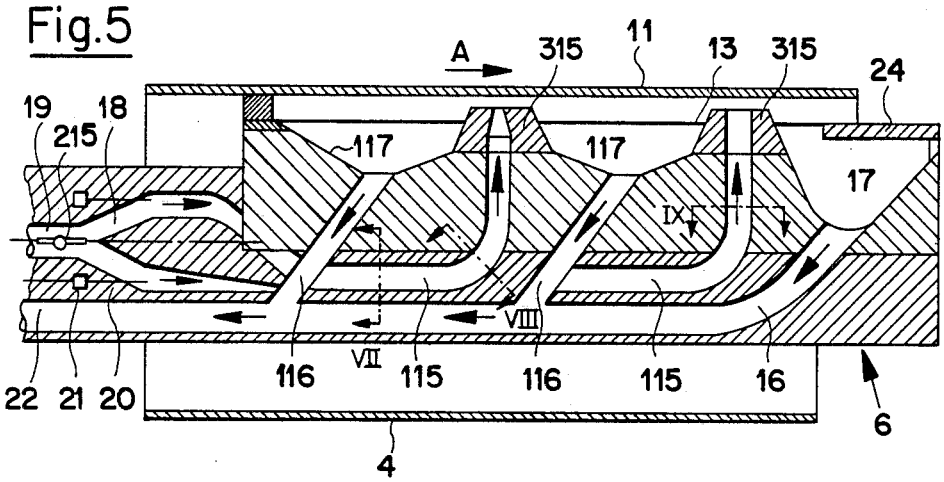
FIG. 5 is a fragmentary longitudinal sectional view of the spraying device in accordance with a further embodiment of the invention.
Figure 6:
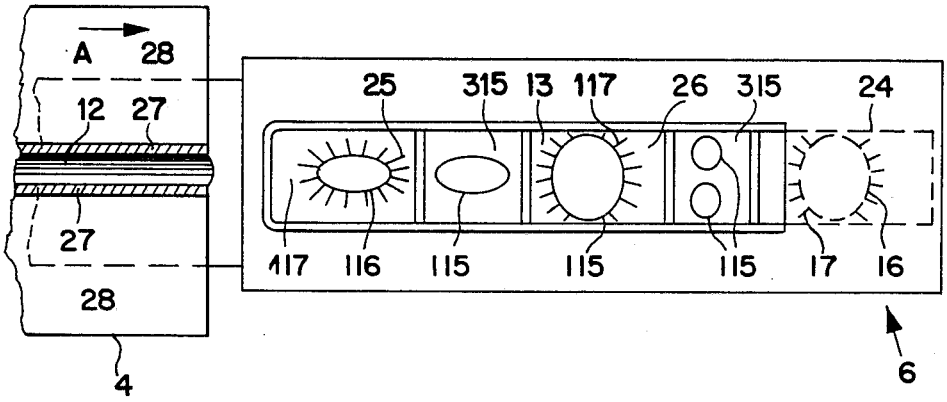
FIG. 6 is a fragmentary plan view of the spraying device of FIG. 5.

In accordance with a further modification of the invention shown in FIGS. 5 and 6, supply passages 115 which guide and supply the powder-air stream extend substantially perpendicular to the outer surface of the can body 4 or to the welding seam 12 thereof, and at a very small distance thereto. The distance between the ends of the passages 115 and the welding seam 12 lie in the region of between 2 mm and 5 mm, advantageously approximately 2.5 mm. The cross section of the discharge mouths or outlet openings of the passages 115 can be round or cornered. The passages 115 can extend in pairs near one another, particularly in the wider zone 26 of the opening 13. Advantageously, easily exchangeable fittable end pieces 315 are arranged at the passages 115. In addition to the suction or aspiration passage 16 which opens into the head chamber 17, further suction or aspiration passages 116 can be provided either before and/or after each passage 115. These suction or aspiration passages or passageways 116 advantageously open into the bottom of funnel-shaped depressions 117 located between the supply passages 115. The suction or aspiration passages or passageways 116 are connected by way of the suction passage 16 with the treating device 8. Again, the aforedescribed vacuum conditions may be advantageously established within the spray chamber by the action of the suction or aspiration passages or passageways 16 and 116 located at the floor of the spray or spraying chamber and laterally of the related supply passages 115, specifically the outlet openings or discharge mouths thereof.

The sealing elements 23 or synthetic belts which run together can be provided laterally of the spraying opening 13, to protect the regions located near the welding seam 12 from deposit of any powder particles. In the embodiment shown in FIGS. 5 and 6 these protective elements can be dispensed with, especially when the passages 115 open very close to the welding seam 12 and as a result of this the powder-air mixture can exit with a very low speed so as to cover the remaining free path up to the seam 12. Powder particles which have not reached the seam, or are loose, are removed by way of the passages 116 from the spraying opening.

However, by virtue of the vacuum conditions which can be established in the spray chamber and for the reasons enunciated more fully previously, it is equally possible to dispense with the use of the sealing elements or ledges 23.

A tiltable flap 215 (FIG. 5) may be provided in the passage 19, and the tilting position of the flap 215 may be adjusted for dosing the powder flow.

When the spraying head 6 is formed with only two passages 15, 115 the distribution of the powder-air stream at the end of the supply passage 19 can also be carried out through a Y-shaped splitting of the passage 19. The electrodes 20 can lie in this case in the legs of the Y-shaped splitting.

Figure 7:
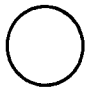
FIGS. 7, 8 and 9 are schematic sectional views of passages of the spraying devices, taken along the lines VII—VII, VIII—VIII and, respectively, IX—IX in FIG. 5.
Figure 8:
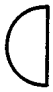
Figure 9:
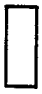
Figure 10:
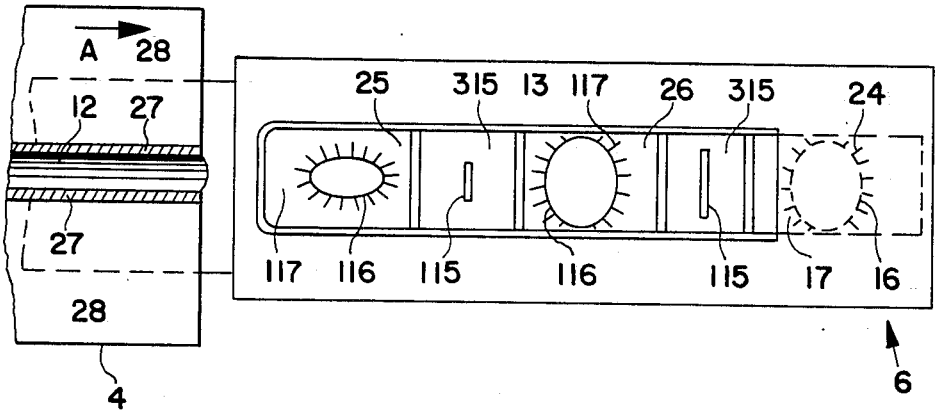
FIG. 10 is a fragmentary plan view of a spraying device.

Particularly during application of the powder in which the greater part of the transport or carrier air flows essentially parallel to the powder stream, the shape of the powder stream during discharge from the powder supply passages 15, 115 is important. The schematic cross-sections shown in FIGS. 7, 8 and 9, and the orifices shown in FIG. 10, illustrate the shapes of the passages 15, 115 which make possible the discharge of the powder as a band-like or strip-like stream normally or at least at an obtuse angle to the welding or weld seam. The initially round cross-section of the powder supply passages 15, 115, starting at the bottom-side part of the passages 15, 115 below the outlet opening, have a rectangular cross section extending to the outlet opening. The powder particles flowing in the air stream or current in the horizontally located portion of the passages 15, 115 are distributed on the flat outer radius and glide there upwardly, where they discharge from the passages 15, 115 as a small band transversely to the seam.

Operation

The can body 4, the seam of which had been welded between the welding rollers 2 and 3, moves from the welding machine 1, by means of a transport system 29, to the which coats only the welding seam 12 is applied from the smaller zone 25 of the spraying opening 13. During passage of the wider zone 26 the powder application takes place in a region which includes not only the welding seam 12, but also the neighboring region 27. Thus the already coated seam region 12 is again coated with powder.

The adherence of the powder to the can body 4 is obtained in a known manner in that the powder particles are electrostatically charged either on the electrodes 20 or by friction in the supply passages 15, whereas the can body 4 has an opposite charge. The adherence can also be obtained by gluing on or fusing to the welding seam 12 which is still hot or retained heated by a heat source (not shown) to a temperature exceeding the melting temperature of the powder.

The supply of the powder into the air stream is performed through the passage 19. After the distribution in the chamber 18 having the shape of a tapered ring or in the Y-shaped end of the passage 19 into one or several supply passages 15 and the static charging, the powder-air stream is guided directly and without further baffles through the spray opening 13 onto the seam 12 of the can body 4, and into the region or recess 27. With the aid of the sealing elements 23, or in the case where it is desired to avoid the use of such sealing elements 23 by applying the aforedescribed vacuum conditions within the spray chamber and preferably at the region of the outlet opening or discharge mouth of each provided supply passage, the application of the powder to the weld seam can be limited exactly to the width of the slot opening 13. The powder particles which have not adhered to the can body 4, and also the transport air are removed through the suction or aspiration passage 16 from the head chamber 17 and/or the funnel-shaped depressions 117. With the inventive measures there is also avoided the formation of any spray cloud of powder particles within the spray or spraying chamber, which otherwise would result in an uncontrolled deposition of the powder particles on the weld seam and neighboring regions thereof.

The powder particles discharged between the successive can bodies 4 are removed by the aspiration device 7. They are supplied again to the treating device 8. After application of powder through the spraying head 6, the can body 4 is displaced along a heat source or heating element 9, so that the powder is melted and forms a coating that firmly adheres to the can body 4.

It is to be understood that the above-described method and apparatus for coating of the inwardly located seam can be utilized analogously for the outer seam coating. It is also to be understood that with the above-described method, application of powder onto a seam located below can also be performed.

The invention is not limited to the details shown since various modifications and structural changes are possible without departing in any way from the spirit and teachings of the present invention.

While there are shown and described present preferred embodiments of the invention, it is to be distinctly understood that the invention is not limited thereto, but may be otherwise variously embodied and practiced within the scope of the following claims. Accordingly,

What we claim is:

1. A method of applying a substantially strip-shaped powder layer onto the inside of a can body to cover a welding seam of said can body, comprising the steps of:

(a) moving said can body in a predetermined direction over spray head such that spray chamber of said spray head is located within said can body;

(b) transporting powder for forming the substantialy strip-shaped powder layer by means of an air stream through at least one supply passageway in said spray head;

(c) discharging said powder in the form of a substantially bundled powder jet from an outlet opening of said at least one supply passageway and which is located at the neighborhood of said welding seam as said can body moves past said spray head;

(d) aspirating from within said spray chamber through at least on aspiration passageway at least a portion of the air of said air stream transporting said powder for removing said air by suction from said spray chamber and for threby ensuring that said substantially bundled power jet is not atomized by said air and that said substantially bundled powder jet is maintained in a bundled configuration;

(e) directing the powder of the bundled powder jet due to its kinetic energy and without the formation of a powder cloud in the direction of the welding seam;

(f) depositing the thus directed powder at the welding seam in order to form said substantially strip-shaped layer upon said welding seam; and (g) aspirating from within said spray chamber the portion of said powder which has not adhered to said welding seam through said at least one aspiration passageway.

2. The method as defined in claim 1, wherein:

said aspiration step entails aspirating said non-adhering portion of the powder through an opening of the at least one aspiration passageway which is located adjacent said outlet opening of said at least one supply passageway.

3. The method as defined in claim 1, wherein:

said aspirating step includes aspirating said non-adhering portion of the powder by means of a number of aspirating passageways located upstream and downstream from said at least one supply passageway in relation to said predetermined direction of movement of the can body.

4. The method as defined in claim 1, wherein:

said aspirating step entails establishing a pressure in said spray chamber of the spray head which is lower than the pressure of the surrounding atmosphere to ensure retention of the bundled powder jet which enters the spray chamber and to prevent the formation of a spray cloud of the powder in the spray chamber.

5. The method as defined in claim 4, further including the step of:

utilizing the lower pressure established in the spray chamber for removing air from the air stream of the bundled powder jet in order to retain the bundled configuration thereof.

6. The method as defined in claim 4, wherein:

said step of establishing said lower pressure in the spray chamber entails establishing a lower pressure in said spray chamber which is sufficient to prevent undesirable flow of particles of the powder laterally from said substantially strip-shaped powder layer deposited onto the welding seam, whereby there can be avoided the use of lateral sealing elements along a spray opening of the spray chamber.

7. The method as defined in claim 1, further including the step of:

electrostatically charging the powder to promote transport of the powder in the direction of the welding seam.

8. The method as defined in claim 1, wherein:

the discharging of the powder is substantially at right angles onto the welding seam.

9. The method as defined in claim 1, wherein:

the discharging of the powder is at a distance of between 2 mm to 5 mm from said welding seam.

10. The method as defined in claim 1, further including the step of:

aspirating the non-adhering powder through said at least one aspirating passageway in a direction essentially parallel to and opposite the direction of movement of the bundled powder jet towards the welding seam.

11. The method as defined in claim 1, wherein:

said aspirating step entails establishing a pressure in said spray chamber of the spray head which is lower than the pressure of the surrounding atmosphere in order to withdraw air from the air stream transporting the powder through said at least one supply passageway; and said lower pressure withdrawing air of the air stream out of the bundled powder jet in a direction substantially opposite to the direction of movement of the bundled powder jet towards the welding seam.

12. The method as defined in claim 1, wherein:

said step (d) of aspirating from within said spray chamber through said at least one aspiration passageway at least said portion of said air entails aspirating laterally of said at least one supply passageway.

13. The method as defined in claim 1, wherein:

said step (d) of aspirating from within said spray chamber through said at least one aspiration passageway at least said portion of said air entails aspirating at the bottom of said spray chamber.

14. An apparatus for applying a substantially strip-shaped powder layer onto the inside of a can body to cover a welding seam of said can body; comprising:

means operable for transporting said can body in a transporting direction;

a spray head capable of being positioned inside said can body when said can body moves insaid transporting direction;

said spray head having at least one supply passageway for transporting said powder by way of an air stream and due to the kinetic energy of the powder in the form of a substantially bundled powder jet towards the wedling seam;

said at least one supply passageway having an outlet opening within said spray head in the vicinity of said welding seam so that said powder is discharged from said at least one supply passageway in the form of said bundled powder jet onto said can body to form said substantially strip-shaped powder layer upon said welding seam;

said spray head further haivng an aspiration passageway for aspirating from within said spray head air of said air stream and excess powder which does not adhere to said can body; and said aspiration passageway having an opening within said spray head and adjacent said outlet opening of said supply passageway.

15. The apparatus as defined in claim 14, wherein:

said opening of said aspiration passageway is located at the bottom of a substantially funnel-shaped depression adjacent said at least one supply passageway.

16. The apparatus as defined in claim 14, wherein:

said spray head contains a spray chamber into which opens said at least one supply passageway and said aspiration passageway;

said at least one supply passageway infeeding the powder by means o said air stream and in the form of said bundled powder jet into the spray chamber for movement towards and for deposition upon the welding seam;

said aspiration passageway serving to establish a pressure in the spray chamber which is lower than the pressure of the surround atmosphere in order to withdraw air from the air stream transporting the powder through said at least one supply passageway; and said lower pressure withdrawing the air out of the bundled powder jet in a direction substantially opposite to the direction of movement of the bundled power jet towards the welding seam.

17. The apparatus as defined in claim 14, wherein:

said opening of said aspiration passageway is located downsteam of the at least one supply passaway.

18. The apparaus as defined in claim 14, wherein:

said opening of said aspiration passageway is located upstream of the at least one supply passageway.

19. The apparatus as defined in claim 14, wherein:

said apiration passageway extends laterally of said at least one supply passageway.

20. The apparatus as defined in claim 14, wherein:

said aspiration passageway has at least one inlet opening with a bottOm region of said spray head.

21. An apparatus for applying a substantially strip-shaped powder layer onto a longitudinally extending inside welding seam of a can body, comprising:

means operable for transporting a can body in a transporting direction;

a spray head arranged inside the can body as said can body moves in said transporting direction for distributing said power to the seam region of said can body;

said spray head having an elongated spray chamber extending substantially parallel to the transporting direction;

said spray chamber having an elongated opening disposed opposite said welding seam of said can body;

said spray head further having at least one powder supply passage which opens into said spray chamber and extends at an angle to the welding seam so that the powder discharges into the spray chamber from said at least one powder supply passage due to the kinetic energy of the powder and without the formation of any powder cloud in the spray chamber and such powder then passes through said elongated opening and comes into contact with the welding seam at said angle to form said substantially strip-shaped layer; and an aspiration passageway coupled to said spray chamber for aspirating excess powder.

22. The apparatus as defined in claim 21, wherein:

said spray head further comprises sealing means located laterally of said elongated opening for limiting application of said powder to a strip-shaped region of the welding seam.

23. The apparatus as defined in claim 22, wherein:

said sealing means comprises bristle strips.

24. The apparatus as defined in claim 21, wherein:

said aspiration passageway has an opening; and said opening of said aspiration passageway is located at the bottom of a substantially funnel-shaped depression adjacent said at least one supply passage.

25. The apparatus as defined in claim 21, wherein:

said at least one powder supply passage and said aspiration passageway each directly open into said spray chamber;

said at least one powder supply passage infeeding the powder by means of an air stream and in the form of a bundled powder jet into the spray chamber for movement towards and for deposition onto the welding seam;

said aspiration passageway serving to establish a pressure in the spray chamber of the spray head which is lower withdraw air from the air stream transporting the powder through said at least one powder supply passage; and said lower pressure withdrawing the air out of the bundled powder jet in a direction substantially opposite to the direction of movement of the bundled powder jet towards the welding seam.

26. The apparatus as defined in claim 21, wherein:

said aspiration passageway extends laterally of said at least one powder supply passage.

27. The apparatus as defined in claim 21, wherein:

said aspiration pasasgeway has an inlet opening in the bottom of said spray chamber.

28. An apparatus for applying a strip-shaped powder layer onto the inside of a can body to cover a welding seam of said can body, comprising in combination:

transporting means operable for transporting a can body in a transporting direction;

a spraying head for distributing a powder carried by air to said seam;

said spraying heasd having an elongated spray opening extending along said transporting direction;

said spraying head further haivng a plurality of passage which are arranged in sequence in the transporting direction of the can body, each passage having an opening in communication with said elongated spray opening, and extending at an angle to the welding seam so that when the powder discharges from each of said passages and passes through said elongated spray opening it comes into contact with the welding seam at said angle;

said spraying had being provided with at least one aspiration passageway for aspirating excess powder;

said elongate spray opening of said spraying head has a smaller portion and a wider portion connected to said smaller portion; and the openings of said passages in communication with the smaller portion of said elongated spray opening of said spraying head are smaller than the openings of the passages in the wider portion of the same.

29. A spray head for applying a strip-shaped powder covering to a longitudinally extending inside welding seam of a can body, said spray head comprising:

means defining an elongated chamber;

a first passageway for delivering powder to said chamber;

a second passageway for aspirating excess powder from said chamber; and said chamber having an elongated opening capable of alignment parallel to said welding seam, said opening having a relatively narrow portion for delivering said powder to said welding seam, and a relatively wide portion for delivering powder to said welding seam and well defined regions on either side of said welding seam.

* * * * *

UNITED STATES PATENT AND TRADEMARK OFFICE

CERTIFICATE OF CORRECTION

PATENT NO. : 4,661,379

DATED : April 28, 1987

INVENTOR(S) : SIEGFRIED FREI et al.

It is certified that error appears in the above-identified patent and that said Letters Patent is hereby corrected as shown below:

Column 1, line 51, after "course" please insert --not economical . When the thickness of the applied layer is--

Column 1, line 62, after "then is" insert --sprayed approximately parallel to the seam into a spraying--

Column 2, line 25, after "through" insert --druses-- and after "nozzles" delete "druses"

Column 2, line 47, after "stream in" insert --the spraying--

Column 3, line 27, delete "of" and insert --or--

Column 3, line 46, delete "or" and insert --of--

Column 6, line 47, after "regions" insert --or recesses--

Column 8, line 8, after "to the" insert --powder applying device 5. Initially, a small powder strip--

Column 9, line 10, after "that" insert --a--

Column 9, line 12, delete "substantialy" and insert --substantially--

Column 9, line 22, delete "on" and insert --one--

Column 9, line 25, delete "threby" and insert --thereby--

Column 10, line 51, after "body" delete ";" and insert --,--

Column 10, line 55, delete "insaid" and insert --in said--

UNITED STATES PATENT AND TRADEMARK OFFICE

CERTIFICATE OF CORRECTION

PATENT NO. : 4,661,379

DATED : April 28, 1987

INVENTOR(S) : SIEGFRIED FREI et al.

It is certified that error appears in the above-identified patent and that said Letters Patent is hereby corrected as shown below:

Column 10, line 61, delete "wedling" and insert --welding--

Column 11, line 1, delete "haivng" and insert --having--

Column 11, line 18, delete "o" and insert --of--

Column 11, line 24, delete "surround" and insert --surrounding--

Column 11, line 31, delete "power" and insert --powder--

Column 11, line 34, delete "passaway" and insert --passageway--

Column 11, line 44, delete "with a bott0m" and insert --within a bottom--

Column 11, line 52, delete "power" and insert --powder--

Column 12, line 28, after "is lower" insert --than the pressure of the surrounding atmosphere in order to--

Column 12, line 39, delete "pasasgeway" and insert --passageway--

Column 12, line 48, delete "heasd" and insert --head--
Column 12, line 50, delete "haivng" and insert --having--

Column 12, line 51, delete "sage" and insert --sages--

Column 12, line 59, delete "had" and insert --head--

UNITED STATES PATENT AND TRADEMARK OFFICE

CERTIFICATE OF CORRECTION

PATENT NO. : 4,661,379

DATED : April 28, 1987

INVENTOR(S) : SIEGFRIED FREI et al.

It is certified that error appears in the above-identified patent and that said Letters Patent is hereby corrected as shown below:

Column 12, line 62, delete "elongate" and insert --elongated--.

Signed and Sealed this

Eighth Day of September, 1987

*Attest:*

DONALD J. QUIGG

*Attesting Officer*

*Commissioner of Patents and Trademarks*